US005988158A

United States Patent [19]

Schmidt, Jr.

[11] Patent Number: 5,988,158

[45] Date of Patent: Nov. 23, 1999

[54] OUTDOOR OVEN APPARATUS

[76] Inventor: Henry G. Schmidt, Jr., 2340 Calhoun Rd., Eagle Lake, Tex. 77434

[21] Appl. No.: 09/179,486

[22] Filed: Oct. 27, 1998

Related U.S. Application Data

[60] Provisional application No. 60/064,844, Nov. 3, 1997.

[51] Int. Cl.[6] ..... F24C 1/16; F24C 15/16; A23L 29/02

[52] U.S. Cl. ..... 126/276; 126/25 R; 126/41 R; 126/337 R; 126/339; 99/339; 99/357

[58] Field of Search ..... 126/25 R, 41 R, 126/276, 339, 337 R, 41 D; 99/339, 357; 219/392, 385, 521, 242

[56] References Cited

U.S. PATENT DOCUMENTS

| | | | |
|---|---|---|---|
| 34,726 | 3/1862 | Ayres | 126/276 |
| 2,851,941 | 9/1958 | Cogar | 126/276 |
| 3,029,754 | 4/1962 | Doyle | 110/240 |
| 4,086,849 | 5/1978 | Simmons | 99/357 |
| 4,757,755 | 7/1988 | Sarten | 99/357 |
| 4,757,756 | 7/1988 | Van Marr | 99/482 |
| 4,819,614 | 4/1989 | Hitch . | |
| 4,840,118 | 6/1989 | Rinehart . | |
| 5,031,602 | 7/1991 | Vick | 126/25 R |
| 5,213,027 | 5/1993 | Tsotsos et al. . | |
| 5,284,125 | 2/1994 | Hunziker . | |
| 5,325,841 | 7/1994 | Hooper, Sr. . | |
| 5,481,964 | 1/1996 | Kitten | 99/339 |

*Primary Examiner*—Ira S. Lazarus
*Assistant Examiner*—David Lee

[57] ABSTRACT

An oven apparatus includes a support unit which supports a cylindrically shaped oven unit which includes a first oven end and a second oven end. An oven access door is located at each oven end. Drawer guide tracks are supported by interior portions of the oven unit and extend outward from the interior portions of the oven unit. Grill drawers are supported by the respective drawer guide tracks. Fuel access doors having adjustable draft valves are located on the respective oven ends, and a damper-containing vent pipe is connected to the oven unit. The oven access doors are supported by the oven ends by horizontally oriented access door hinges. The oven access doors are located above the drawer guide tracks. The oven unit includes drain ports located at bottom portions of the oven unit. A thermometer is supported by the oven unit. First and second trays are supported at the respective oven ends, and the trays are located astride of the oven access doors. A fuel support grate is located within the oven unit at a level above the drain ports. An upper rack is supported by support hooks within the oven unit above the oven access doors. Longitudinally extending trays are located on outside walls of the oven unit. A carriage assembly can be employed for supporting the support unit. Also, a trailer hitch assembly can be connected to the support unit. Props are connected to the support unit to retain the apparatus in a horizontal orientation.

14 Claims, 3 Drawing Sheets

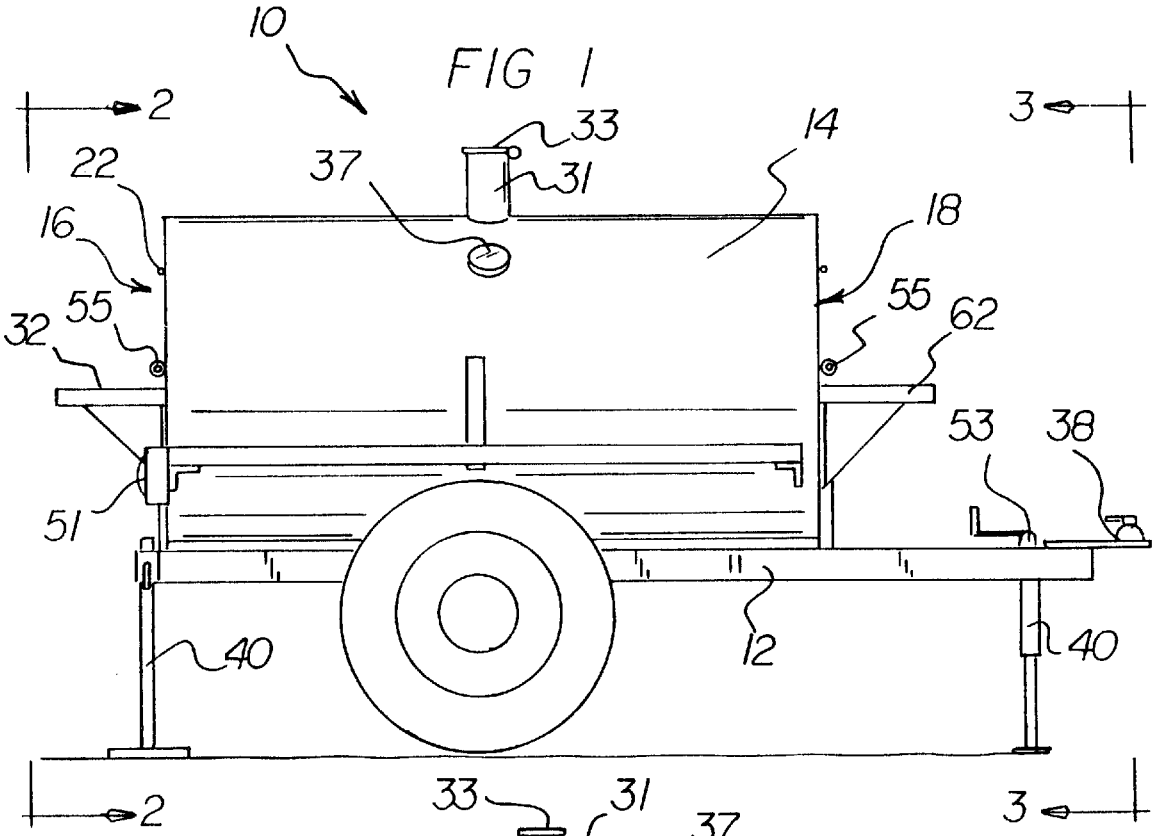
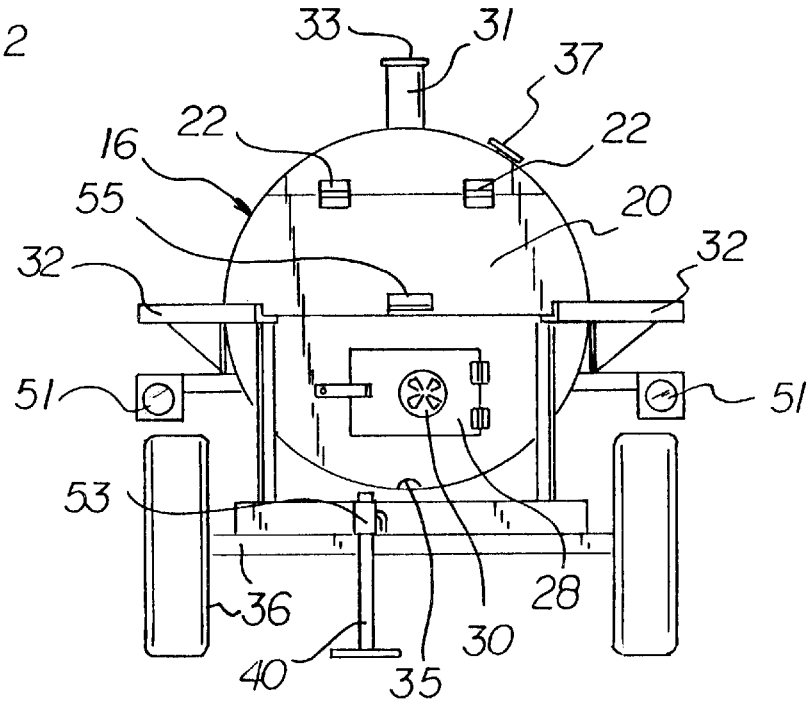
FIG 2

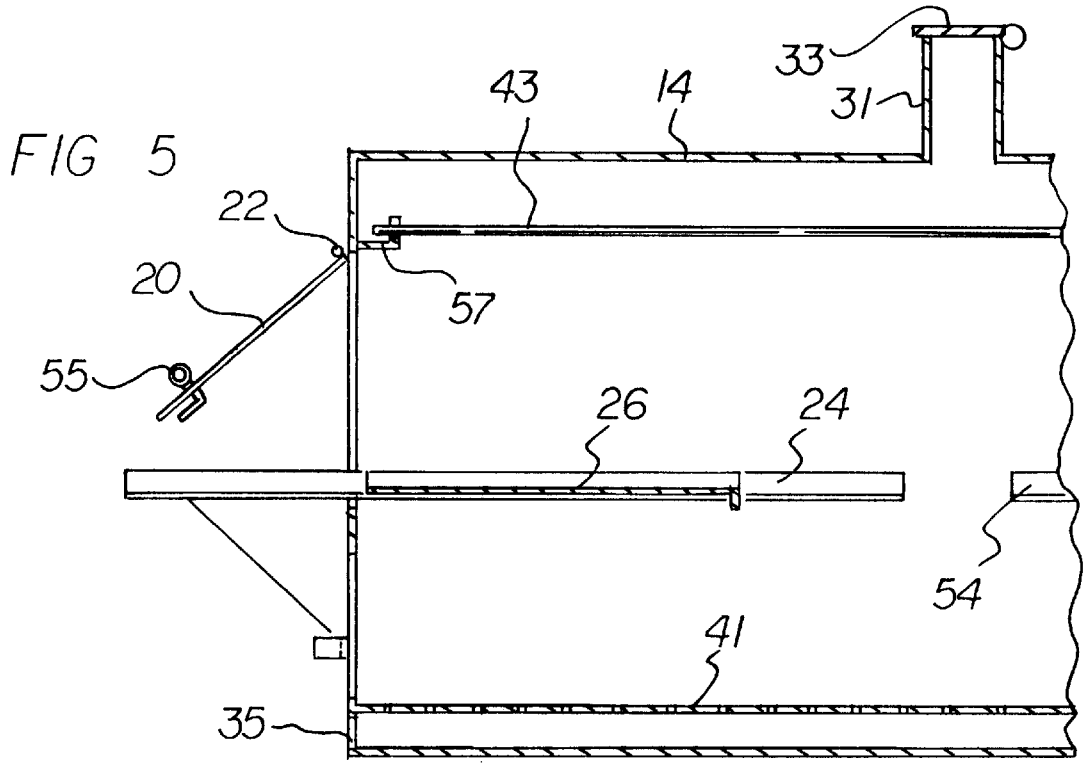
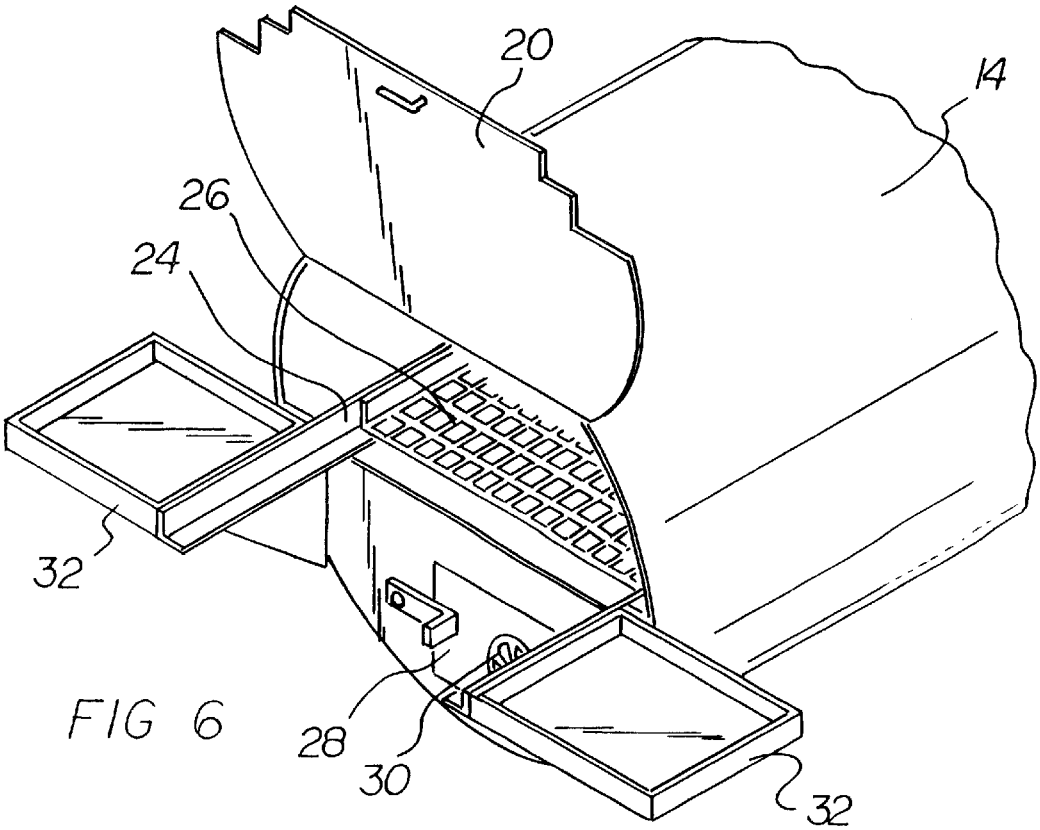
FIG 6

OUTDOOR OVEN APPARATUS

CROSS-REFERENCE TO RELATED APPLICATION

This application claims priority based upon my prior copending Provisional Application Serial No. 60/064,844, filed Nov. 3, 1997.

BACKGROUND OF THE INVENTION

1. Field of the Invention

The present invention relates generally to cooking devices and, more particularly, to cooking devices that are portable and are generally used outdoors.

2. Description of the Prior Art

Cooking outdoors is a popular activity, and throughout the years, a number of innovations have been developed relating to outdoor cooking devices. The following U.S. patents are representative of some of those outdoor cooking innovations: U.S. Pat. Nos. 4,819,614, 4,840,118, 5,213,027, 5,284,125, and 5,325,841. More specifically, each of U.S. Pat. Nos. 4,819,614, 4,840,118, and 5,213,027 discloses a barbecue grill which is rectangular in shape having two long sides and two short ends. Access to the interior of the grill is obtained from one of the long sides. As a consequence, the interior of the oven is accessible only a relatively short depth along a relatively long length. In contrast, for purposes of heat retention when the oven interior is accessed, it would be desirable if an outdoor oven apparatus were provided that has an oven interior accessible a relatively long depth along a relatively short length.

Each of U.S. Pat. Nos. 5,284,125 and 5,325,841 discloses what appears to be a vertically oriented cylindrical outdoor oven apparatus which has only one access door on the side of the cylindrical oven. In general, a rectangular outdoor oven apparatus may be preferred over a vertically oriented cylindrical one because a rectangular oven apparatus may provide greater stability with respect to being tipped over. Moreover, the vertically oriented cylindrical ovens disclosed have single access doors. For purposes of greater versatility in oven utilization, it would be desirable if an outdoor oven apparatus were provided which had access doors at each end of the oven.

Still other features would be desirable in an outdoor oven apparatus. For example, for ease moving food into and out from the oven interior, it would be desirable if an outdoor oven apparatus were provided with sliding drawers that are accessed from ends of the oven. For removing melted fats from the oven interior, to preclude excessive smokiness due to burning fat, it would be desirable if an outdoor oven apparatus were provided with drain ports located at the bottom of the oven. The drain ports can also be used for allowing ashes to exit from the oven interior when the oven interior is washed out.

Some foods cook at a lower temperature or are more susceptible to heat damage than others. In this respect, to keep some foods farther away from a heat source than others, it would be desirable if an outdoor oven apparatus were provided with an upper food rack that is more distant from a heat source than a lower food rack which is closer to the heat source.

For ease of transportation, it would be desirable if the outdoor oven apparatus were supported by a wheeled carriage. For convenience in pulling the outdoor oven apparatus, it would be desirable if the wheeled carriage included a trailer hitch so that the outdoor oven apparatus could be readily towed by a motorized vehicle.

The degree of combustion of the fuel in an oven depends significantly upon the amount of air which is permitted to react with the combusting fuel. In this respect, it would be desirable if an outdoor oven apparatus were provided with adjustable draft valves for controlling the amount of air that combusts the fuel.

Thus, while the foregoing body of prior art indicates it to be well known to use outdoor barbecue grills, the prior art described above does not teach or suggest an outdoor oven apparatus which has the following combination of desirable features: (1) has an oven interior accessible along a relatively long depth and a relatively short length; (2) has access doors at each end of the oven; (3) has sliding drawers that are accessed from ends of the oven; (4) has drain ports located at the bottom of the oven; (5) has an upper food rack that is more distant from a heat source than a lower food rack with is closer to the heat source; (6) is supported by a wheeled carriage; (7) includes a trailer hitch so that the outdoor oven apparatus can be readily towed by a motorized vehicle; and (8) is provided with adjustable draft valves for controlling the amount of air that combusts the fuel. The foregoing desired characteristics are provided by the unique outdoor oven apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an oven apparatus which includes a support unit and an oven unit supported by the support unit. The oven unit includes a first oven end and a second oven end. A first oven access door is located on the first oven end. First drawer guide tracks are supported by interior portions of the oven unit. The first drawer guide tracks extend outward from the interior portions of the oven unit. A first grill drawer is supported by the first drawer guide tracks. A first fuel access door is located on the first oven end. A fit adjustable draft valve is located on the first oven end, and a vent pipe is connected to the oven unit.

The first oven access door is supported by the first oven end by means of horizontally oriented first access door hinges. The first oven access door is located above the first drawer guide tracks. The vent pipe includes a damper. The oven unit includes drain ports located at bottom portions of the oven unit. A thermometer is supported by the oven unit. First trays are supported at the first oven end. The first trays are located astride of the first oven access door. A fuel support grate is located within the oven unit. The fuel support grate is located at a level above the drain ports.

An upper rack is supported by support hooks within the oven unit above the first oven access door. Longitudinally extending trays are located on outside walls of the oven unit.

A carriage assembly can be employed for supporting the support unit. The carriage assembly includes an axle and housing assembly connected to the support unit. Also, a trailer hitch assembly can be connected to the support unit. Props are connected to the support unit.

A second oven access door is located on the second oven end. Second drawer guide tracks are supported by interior portions of the oven unit. The second drawer guide tracks extend outward from the interior portions of the oven unit. A second grill drawer is supported by the second drawer guide tracks. A second fuel access door is located on the second oven end. A second adjustable draft valve is located on the second oven end. Second trays are supported at the second oven end. The second trays are located astride of the second oven access door. The oven unit has a cylindrical shape.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved outdoor oven apparatus which has all of the advantages of the prior art and none of the disadvantages.

It is another object of the present invention to provide a new and improved outdoor oven apparatus which may be easily and efficiently manufactured and marketed.

It is a further object of the present invention to provide a new and improved outdoor oven apparatus which is of durable and reliable construction.

An even further object of the present invention is to provide a new and improved outdoor oven apparatus which is susceptible of a low cost of manufacture with regard to both materials and labor, and which accordingly is then susceptible of low prices of sale to the consuming public, thereby making such outdoor oven apparatus available to the buying public.

Still yet a further object of the present invention is to provide a new and improved outdoor oven apparatus which has an oven interior accessible along a relatively long depth and a relatively short length.

Still another object of the present invention is to provide a new and improved outdoor oven apparatus that has access doors at each end of the oven.

Yet another object of the present invention is to provide a new and improved outdoor oven apparatus which has sliding drawers that are accessed from ends of the oven.

Even another object of the present invention is to provide a new and improved outdoor oven apparatus that has drain ports located at the bottom of the oven.

Still a further object of the present invention is to provide a new and improved outdoor oven apparatus which has an upper food rack that is more distant from a heat source than a lower food rack with is closer to the heat source.

Yet another object of the present invention is to provide a new and improved outdoor oven apparatus that is supported by a wheeled carriage.

Still another object of the present invention is to provide a new and improved outdoor oven apparatus which includes a trailer hitch so that the outdoor oven apparatus can be readily towed by a motorized vehicle.

Yet another object of the present invention is to provide a new and improved outdoor oven apparatus that is provided with adjustable draft valves for controlling the amount of air that combusts the fuel.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of the outdoor oven apparatus of the invention.

FIG. 2 is a first end view of the embodiment of the outdoor oven apparatus shown in FIG. 1 taken along line 2—2 of FIG. 1.

FIG. 5 is an enlarged cross-sectional view of the embodiment of the outdoor oven apparatus of FIG. 4 taken along line 5—5 thereof.

FIG. 6 is a perspective view of the first end of the embodiment of the invention shown in FIG. 2.

DESCRIPTION OF THE PREFERRED EMBODIMENT

With reference to the drawings, a new and improved outdoor oven apparatus embodying the principles and concepts of the present invention will be described.

Figure 3:
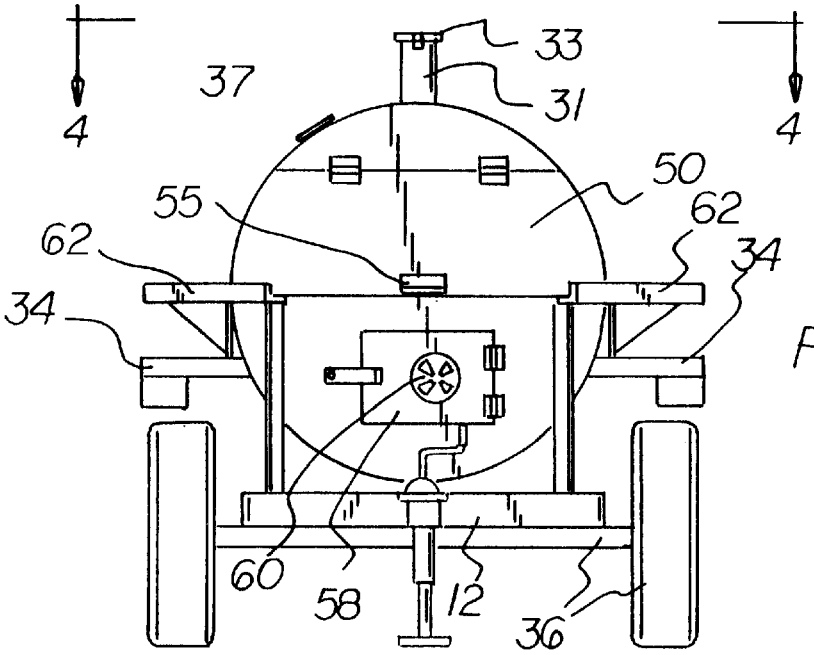
FIG. 3 is a second end view of the embodiment of the outdoor oven apparatus shown in FIG. 1 taken along line 3—3 of FIG. 1.
Figure 4:
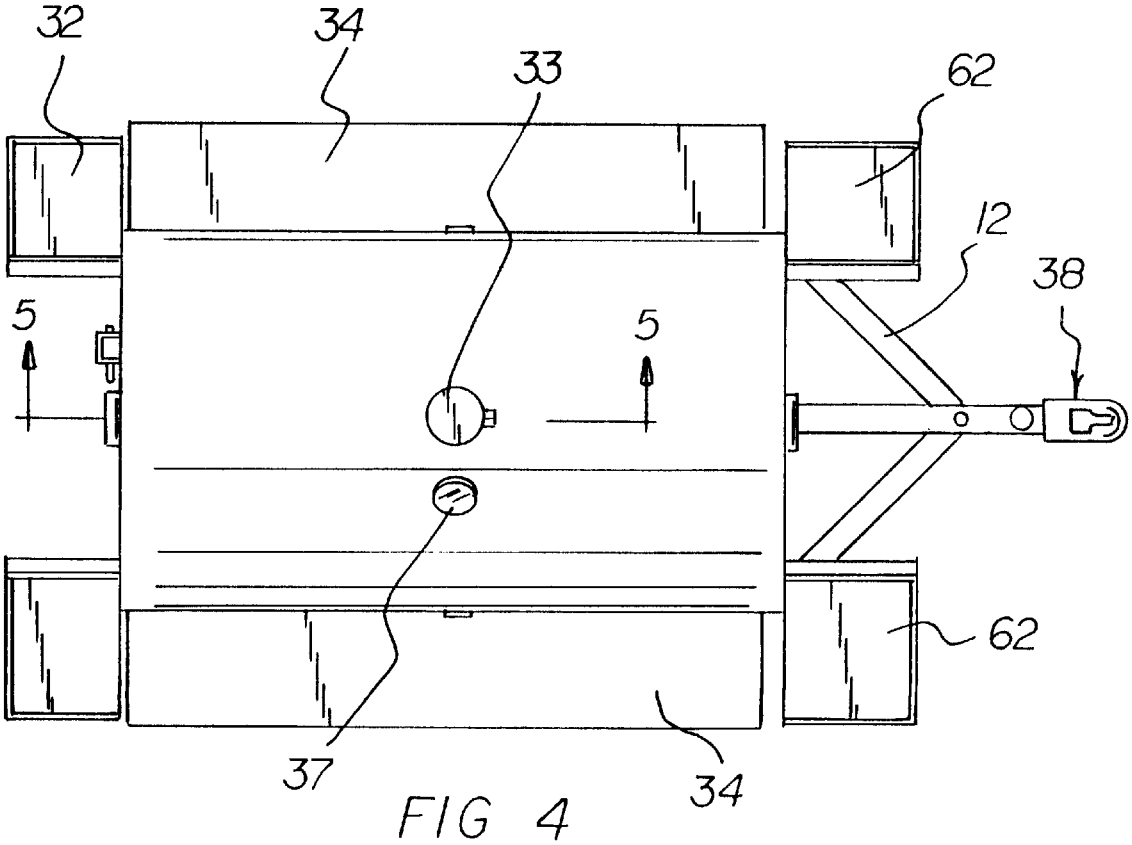
FIG. 4 is a top view of the embodiment of the outdoor oven apparatus shown in FIG. 1 taken along line 4—4 of FIG. 3.

Turning to FIGS. 1–6, there is shown an exemplary embodiment of the outdoor oven apparatus of the invention generally designated by reference numeral 10. In its preferred form, outdoor oven apparatus 10 includes a support unit 12, and an oven unit 14 is supported by the support unit 12. The oven unit 14 includes a first oven end 16 and a second oven end 18. A first oven access door 20 is located on the first oven end 16. First drawer guide tracks 24 are supported by interior portions of the oven unit 14. The first drawer guide tracks 24 extend outward from the interior portions of the oven unit 14. A first grill drawer 26 is supported by the first drawer guide tracks 24. A first fuel access door 28 is located on the first oven end 16. A first adjustable draft valve 30 is located on the first oven end 16, and a vent pipe 31 is connected to the oven unit 14.

The first oven access door 20 is supported by the first oven end 16 by means of horizontally oriented first access door hinges 22. The first oven access door 20 is located above the first drawer guide tracks 24. The vent pipe 31 includes a damper 33. The oven unit 14 includes drain ports 35 located at bottom portions of the oven unit 14. A thermometer 37 is supported by the oven unit 14. The thermometer 37 extends into the interior of the oven unit 14. First trays 32 are supported at the first oven end 16. The first trays 32 are located astride of the first oven access door 20. A fuel support grate 41 is located within the oven unit 14. The fuel support grate 41 is located at a level above the drain ports 35.

An upper rack 43 is supported by support hooks 57 within the oven unit 14 above the first oven access door 20. The upper rack 43 can be used for retaining food items that are smoked. Longitudinally extending trays 34 are located on outside walls of the oven unit 14.

A carriage assembly can be employed for supporting the support unit 12. The carriage assembly includes an axle and housing assembly 36 connected to the support unit 12. Also, a trailer hitch assembly 38 can be connected to the support unit 12. Props 40 are connected to the support unit 12.

A second oven access door 50 is located on the second oven end 16. Second drawer guide tracks 54 are supported by interior portions of the oven unit 14. The second drawer guide tracks 54 extend outward from the interior portions of the oven unit 14. A second grill drawer is supported by the second drawer guide tracks 54. A second fuel access door 58 is located on the second oven end 16. A second adjustable draft valve 60 is located on the second oven end 18. Second trays 62 are supported at the second oven end 18. The second trays 62 are located astride of the second oven access door 50. The oven unit 14 has a cylindrical shape.

In using the oven apparatus 10 of the invention, charcoal (not shown) is placed in the fuel support grate 41. The charcoal is lighted. The burn rate of the charcoal is adjusted by adjusting the first adjustable draft valve 30, the second adjustable draft valve 60, and the damper 33. The first oven access door 20 is unlocked and lifted. The first grill drawer 26 is slid along the first drawer guide tracks 24 to a position outside the oven unit 14. Food items (not shown) are placed on the first grill drawer 26. When the firs grill drawer 26 is outside the oven unit 14, even with the first oven access door 20 open, most of the heat is retained inside the oven unit 14 when the food is treated because the first oven access door 20 is at an end of the oven unit 14 and aside the coals as opposed to is directly over the coals. Moreover, if it is raining, the rain is impeded from entering the oven unit 14 because the first oven access door 20 does not cover the coals. Then the first grill drawer 26 is slid back into the oven unit 14 where cooking takes place.

The first trays 32 can be used for food preparation or for retaining cooked items. Since the first trays 32 are astride the first oven access door 20 and the first grill drawer 26, the first trays 32 are easily accessed when the first grill drawer 26 is outside the oven unit 14. If desired, other food items (not shown) can be placed on the upper rack 43 where smoke concentrates. In this respect, the upper rack 43 is used for smoking items.

The first fuel access door 28 and the second fuel access door 58 are preferably made wide enough so that a shovel can be placed through the respective fuel access doors into the oven unit 14. Thermometer 37 indicates the temperature inside the oven unit 14. The damper 33 and the adjustable draft valves are adjusted to control the temperature of combustion, whereby the temperature inside the oven unit 14 is adjusted. Other fuels, such as bottled gas, can be employed instead of charcoal. The first trays 32 and the second trays 62 are in grid form and can be made from expanded metal.

Tail lights 51 can be provided. In addition, a leveling jack 53 can be provided as well. Handles 55 can be provided for facilitating movement of the respective doors. When the inside of the oven unit 14 is washed out with water, the washings can drain out from the drain ports 35.

The components of the outdoor oven apparatus of the invention can be made primarily from inexpensive and durable metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved outdoor oven apparatus that is low in cost, relatively simple in design and operation, and which has an oven interior accessible along a relatively long depth and a relatively short length. With the invention, an outdoor oven apparatus is provided which has access doors at each end of the oven. With the invention, an outdoor oven apparatus is provided which has sliding drawers that are accessed from ends of the oven. With the invention, an outdoor oven apparatus is provided which has drain ports located at the bottom of the oven. With the invention, an outdoor oven apparatus is provided which has an upper food rack that is more distant from a heat source than a lower food rack which is closer to the heat source. With the invention, an outdoor oven apparatus is provided which is supported by a wheeled carriage. With the invention, an outdoor oven apparatus is provided which includes a trailer hitch so that the outdoor oven apparatus can be readily towed by a motorized vehicle. With the invention, an outdoor oven apparatus is provided with adjustable draft valves for controlling the amount of air that combusts the fuel.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. An oven apparatus, comprising:

a support unit, a oven unit supported by said support unit, wherein said oven unit includes a first oven end and a second oven end, a first oven access door located on said first oven end, first drawer guide tracks supported by interior portions of said oven unit, wherein said first drawer guide tracks extend outward from said interior portions of said oven unit, a first grill drawer supported by said first drawer guide tracks, and wherein said apparatus further includes:

first trays supported at said first oven end, wherein said first trays are located astride of said first oven access door and are juxtaposed respectively to said first drawer guide tracks extending outward from said interior portions of said oven unit.

2. The apparatus of claim 1 wherein said first oven access door is supported by said first oven end by means of horizontally oriented first access door hinges.

3. The apparatus of claim 1 wherein said first oven access door is located above said first drawer guide tracks.

4. The apparatus of claim 1 wherein said oven unit includes drain ports located at bottom portions of said oven unit.

5. The apparatus of claim 4, further including:

a fuel support grate located within said oven unit, wherein said fuel support grate is located above said drain ports.

6. The apparatus of claim 1, further including:

a thermometer supported by said oven unit.

7. The apparatus of claim 1, further including:

an upper rack supported within said oven unit above said first oven access door.

8. The apparatus of claim 1, further including:

longitudinally extending trays located on outside walls of said oven unit.

9. The apparatus of claim 1, further including:

a carriage assembly supporting said support unit.

10. The apparatus of claim 9 wherein said carriage assembly includes:

an axle and housing assembly connected to said support unit, and a trailer hitch assembly connected to said support unit.

11. The apparatus of claim 1, further including:

props connected to said support unit.

12. The apparatus of claim 1, further including:

a second oven access door located on said second oven end, second drawer guide tracks supported by second interior portions of said oven unit, wherein said second drawer guide tracks extend outward from said second interior portions of said oven unit, and a second grill drawer supported by said second drawer guide tracks.

13. The apparatus of claim 12, further including:

second trays supported at said second oven end, wherein said second trays are located astride of said second oven access door.

14. The apparatus of claim 1 wherein said oven unit has a horizontally oriented cylindrical shape.

* * * * *